US010415258B2

(12) United States Patent
Gautreau et al.

(10) Patent No.: US 10,415,258 B2
(45) Date of Patent: Sep. 17, 2019

(54) HOCKEY FLOORING TILE

(71) Applicant: Hockeyshot Inc., Scoudouc (CA)

(72) Inventors: Chris Gautreau, Dieppe (CA); Jean-Jacques Cormier, Memramcook (CA)

( * ) Notice: Subject to any disclaimer, the term of this patent is extended or adjusted under 35 U.S.C. 154(b) by 0 days.

(21) Appl. No.: 15/801,666

(22) Filed: Nov. 2, 2017

(65) Prior Publication Data

US 2018/0119430 A1 May 3, 2018

(30) Foreign Application Priority Data

Nov. 3, 2016 (CA) ..... 2947352

(51) Int. Cl.

| | |
|---|---|
| ***E04F 15/02*** | (2006.01) |
| ***A63C 19/10*** | (2006.01) |
| ***E01C 13/04*** | (2006.01) |
| ***E01C 13/10*** | (2006.01) |
| ***E04F 15/18*** | (2006.01) |
| ***E04F 15/22*** | (2006.01) |

(52) U.S. Cl.

CPC ..... *E04F 15/02038* (2013.01); *A63C 19/10* (2013.01); *E01C 13/045* (2013.01); *E01C 13/10* (2013.01); *E04F 15/181* (2013.01); *E04F 15/185* (2013.01); *E04F 15/22* (2013.01); *E04F 15/02183* (2013.01); *E04F 2201/0138* (2013.01); *E04F 2201/09* (2013.01); *E04F 2201/091* (2013.01); *E04F 2201/095* (2013.01); *E04F 2201/098* (2013.01); *E04F 2203/00* (2013.01); *E04F 2290/00* (2013.01)

(58) Field of Classification Search

CPC ..... E04F 15/02038; E04F 2201/091; E04F 2203/00; E04F 2201/098; E04F 2201/095; E04F 2201/0138; E04F 15/02183; E04F 2290/00

See application file for complete search history.

(56) References Cited

U.S. PATENT DOCUMENTS 4,018,025 A * 4/1977 Collette ..... E01C 13/107 404/41
5,052,158 A * 10/1991 D'Luzansky ..... A47G 27/0293 404/41

(Continued)

FOREIGN PATENT DOCUMENTS

DE 202013101282 U1 * 4/2013 ..... E04F 13/076
EP 2894276 A1 * 7/2015 ..... E04F 15/18

(Continued)

OTHER PUBLICATIONS

European Office Action, Application No. 17199845.3-1002, Apr. 1, 2019, 5 pages.

*Primary Examiner* — Rodney Mintz

(74) *Attorney, Agent, or Firm* — The Roy Gross Law Firm, LLC; Roy Gross

(57) ABSTRACT

The present invention discloses a hockey flooring tile having a top smooth surface for passing pucks and one or more interconnecting mechanisms allowing for an interconnection with another tile. A locking mechanism is also positioned within the interconnecting mechanism allowing for a tile to be locked to another tile. The tile disclosed in the present invention also has a bottom surface having support points to support a tile when a weight is placed on the tile.

5 Claims, 8 Drawing Sheets

(56) References Cited

U.S. PATENT DOCUMENTS 5,791,114 A * 8/1998 Mandel ..... E01C 5/20 52/591.3
5,904,021 A * 5/1999 Fisher ..... A63C 19/04 472/92
6,061,979 A * 5/2000 Johannes ..... A63C 19/10 472/89
6,751,912 B2 * 6/2004 Stegner ..... E01C 5/20 52/177
7,797,890 B2 * 9/2010 Thrush ..... E04F 15/10 446/116
8,099,915 B2 * 1/2012 Moller, Jr. ..... E01C 5/20 52/177
8,782,989 B2 * 7/2014 Tang ..... E04F 15/02005 52/589.1
8,806,822 B1 * 8/2014 Wang ..... E04F 15/02038 273/153 R
8,806,831 B1 * 8/2014 Dreyer ..... E04F 15/02038 52/177
2002/0189176 A1 * 12/2002 Stegner ..... E01C 5/20 52/177
2003/0093966 A1 * 5/2003 Chang ..... B44C 3/123 52/604
2004/0258869 A1 * 12/2004 Walker ..... E01C 5/20 428/44
2007/0059481 A1 * 3/2007 Lin ..... E04F 15/02 428/80
2007/0199257 A1 * 8/2007 Thrush ..... E04F 15/10 52/180
2009/0031658 A1 * 2/2009 Moller, Jr. ..... E01C 5/20 52/403.1
2009/0047451 A1 * 2/2009 Huss ..... B29C 39/003 428/33
2010/0300027 A1 * 12/2010 Bravo ..... E04F 15/043 52/311.1
2011/0003110 A1 * 1/2011 Heartsfield ..... E04F 15/02 428/99
2015/0361675 A1 * 12/2015 Cerny ..... E04B 5/026 52/509
2016/0129299 A1 * 5/2016 Newman ..... A63B 21/4037 482/142
2016/0153202 A1 * 6/2016 Matchung ..... E01C 5/20 52/220.2
2017/0101789 A1 * 4/2017 Cormier ..... E04F 15/02183
2017/0326810 A1 * 11/2017 Neill ..... A47L 23/266
2017/0326833 A1 * 11/2017 Neill ..... A47L 23/266

FOREIGN PATENT DOCUMENTS

FR 2989984 A1 * 11/2013 ..... E01C 5/20
GB 2490870 A * 11/2012 ..... A63C 19/02
WO WO-2011001326 A2 * 1/2011 ..... E04F 15/02038

* cited by examiner

HOCKEY FLOORING TILE

FIELD OF THE INVENTION

The present invention relates to flooring tiles. More specifically, the present invention relates to individual hockey flooring tiles which can be interconnected to form a large surface.

BACKGROUND

Synthetic ice surfaces are used as an alternative to ice in a variety of winter sports, but primarily used for hockey. Natural ice, when used for winter sports is hard to build and maintain. In addition, natural ice requires a low temperature environment thereby maintaining solid consistency of the ice. This is often hard or highly expensive in warm temperature climates where it is quite impractical to install natural ice surface. As such, synthetic ice surface is a good alternative. Synthetic surfaces can be installed indoors or outdoors and do not require the same level of upkeep or constant refrigeration. However, synthetic ice surfaces panels are expensive.

A solution to the above problems is to create a surface from numerous hockey floor tiles which consists of a plurality of tiles installed over a sub-floor or directly onto the ground. Once the hockey floor tiles are installed or interconnected to one another, seams where the tiles are interconnected will be created and it is important to have the tiles fit as tightly as possible. Additionally, most of the sports played on sport related tiles usually place a high amount of lateral force on the surface, therefore, it is crucial for the tiles to be linked tightly and prohibit separation. In addition to the lateral force placed on the tiles, the tiles may experience expansion and contraction according to the ambient temperature. Thus, there is a need to design a flooring tile for hockey related activities whose seam joints are resistant to separation.

SUMMARY

In a first aspect, the present invention provides a hockey flooring tile comprising a top smooth surface for passing pucks and one or more interconnecting mechanisms allowing for an interconnection with another tile. The tile also has a locking mechanism positioned within the interconnecting means allowing for a tile to be locked to another tile. The tile of the present invention also has a bottom surface having support means to support the tiles when a weight is placed on the tile.

PARTS LABELLED IN THE DRAWINGS

10 Hockey Floor Tile
15 Upper Surface
20 Lower Surface
25 Interconnecting mechanism
26 Neck
27 Furrow
28 Guiding Neck
30 Cup Shaped Projection
35 Moveable surface
40 A first Nub on a neck
42 A second Nub on a neck
44 A first Nub on a furrow
46 A second Nub on a furrow

BRIEF DESCRIPTION OF THE DRAWINGS

It will now be convenient to describe the invention with particular reference to one embodiment of the present invention. It will be appreciated that the drawings relate to one embodiment of the present invention only and are not to be taken as limiting the invention.

DETAILED DESCRIPTION

The present invention will now be described more fully hereinafter with reference to the accompanying drawings, in which preferred and other embodiments of the invention are shown. No embodiment described below limits any claimed invention and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention. The applicants, inventors or owners reserve all rights that they may have in any invention claimed in this document, for example the right to claim such an invention in a continuing application and do not intend to abandon, disclaim or dedicate to the public any such invention by its disclosure in this document.

The terms "coupled", "connected" and "interconnected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship). The term interconnected can also include a modular aspect to the components allowing for easy construction or flexible arrangement.

Figure 1:
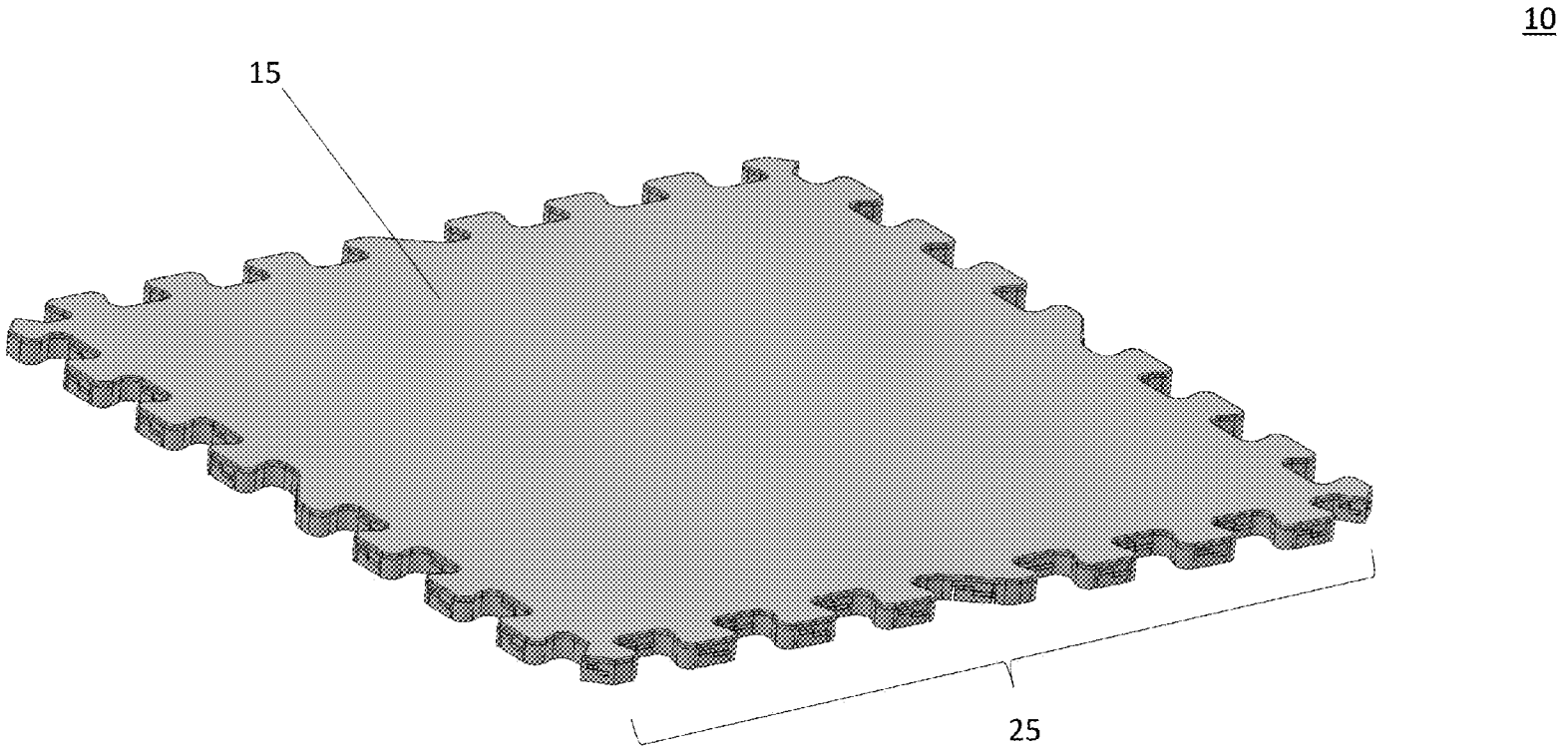
FIG. 1 is a perspective top view of a hockey floor tile according to one embodiment of the present invention.
Figure 2:
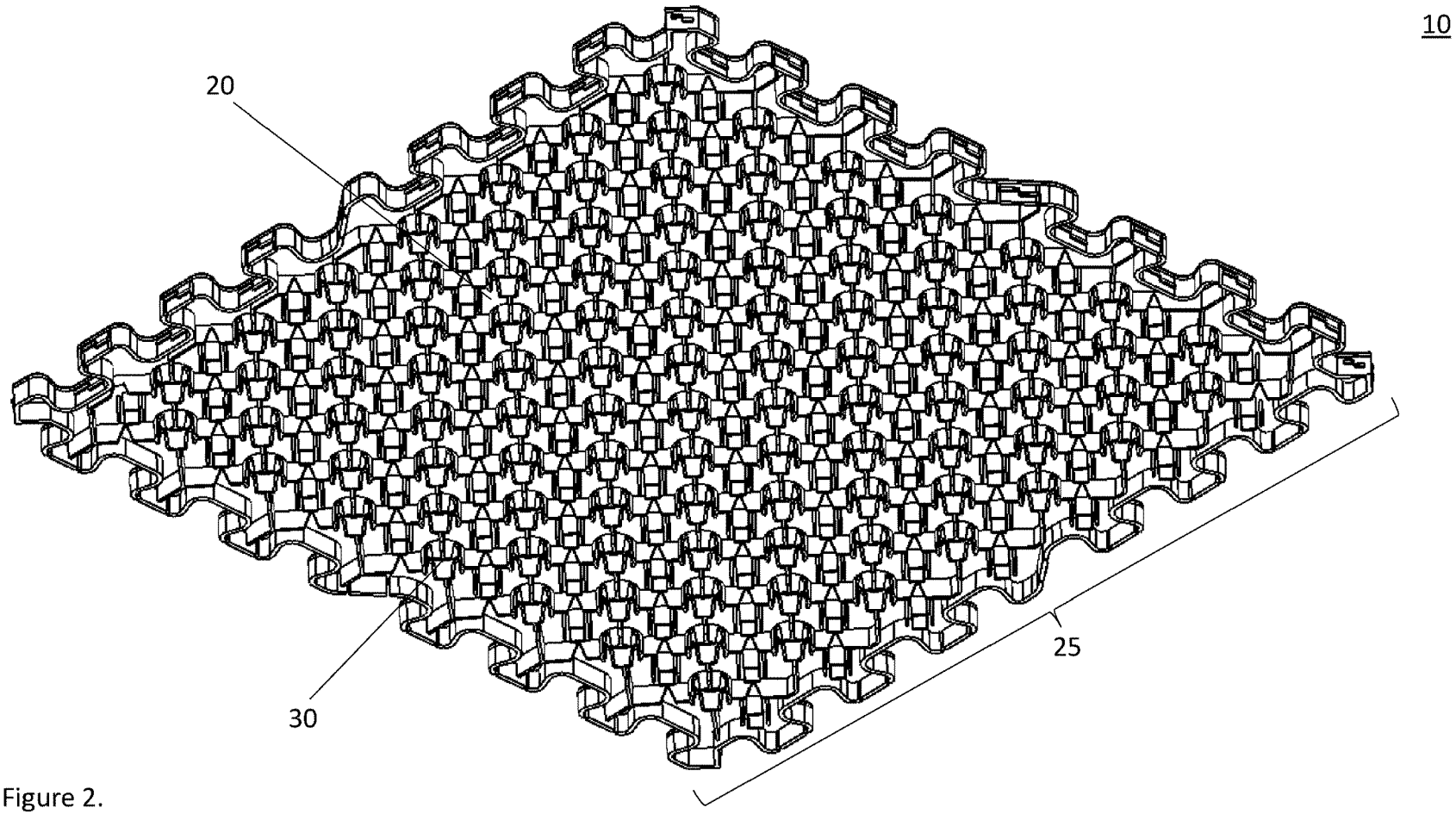
FIG. 2 is a perspective bottom view of a hockey floor tile according to one embodiment of the present invention.
Figure 3:
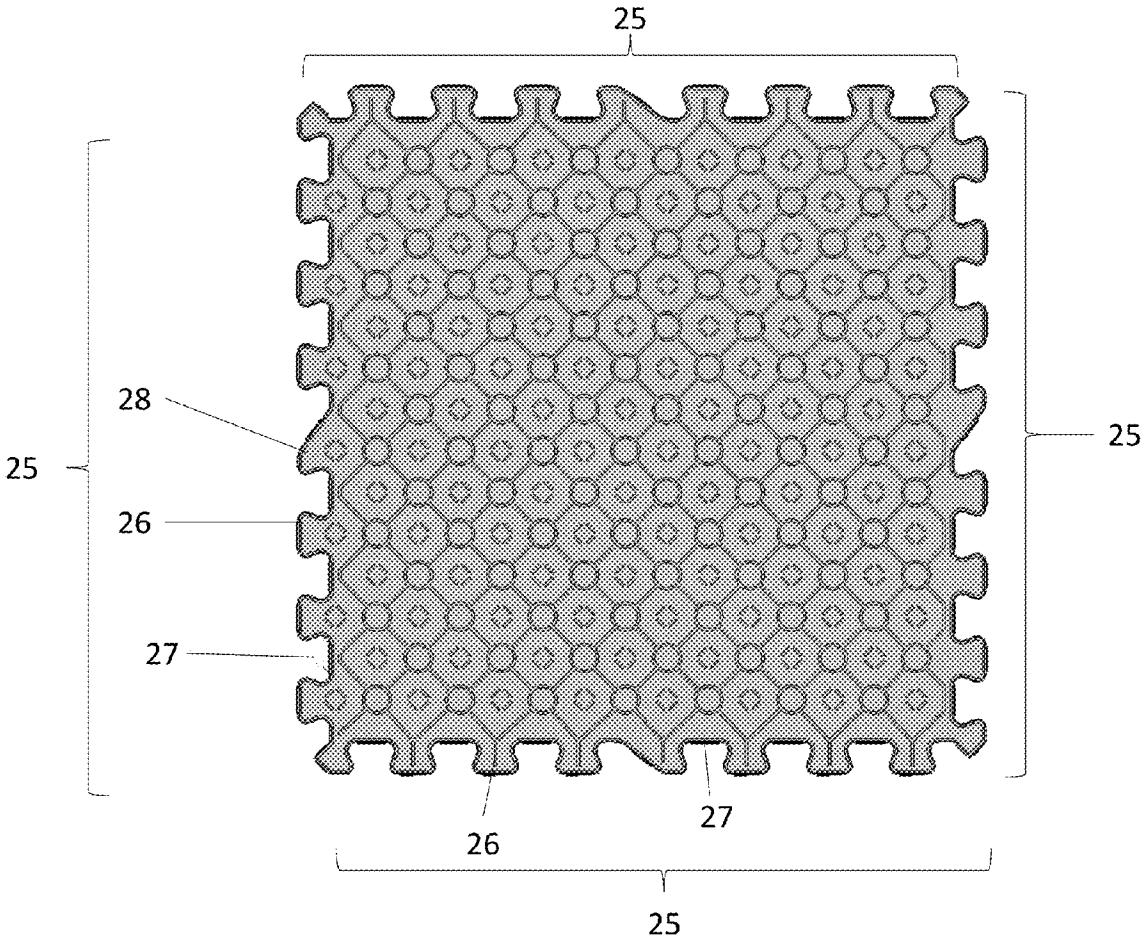
FIG. 3 is a bottom view of a hockey floor tile according to one embodiment of the present invention.

With reference to FIGS. 1, 2 and 3, and according to one embodiment of the present invention, a hockey floor tile 10 is shown. The hockey floor tile is comprised of an upper surface 15, a lower surface 20, and interconnecting mechanisms 25 along the length or edges of the hockey floor tile 10. A worker skilled in the relevant art would appreciate that the interconnecting mechanism 25 can be located on two, three, or four sides of the hockey floor tile 10, depending on the placement of the hockey floor tile 10 within an overall surface comprised of hockey floor tiles of the present invention. The hockey floor tiles 10 used to form the outer perimeter of a large surface can contain four or three interconnecting mechanism 25 along the edges of such tiles, while for example hockey floor tiles used for corners for a large surface can contain two or more interconnecting mechanisms 25 along the edges of such corner tiles. The upper surface 15 of the hockey floor tiles 10 contains a smooth ice like surface, which allows for a smooth surface to be present and provides a sliding feature for pucks. A worker skilled in the relevant art would appreciate the consistency and density of the material of the upper surface 15 that would replicate a smooth surface allowing for an ease to pass packs on the tiles. A worker skilled in the relevant art would also be familiar with the positioning of the locking mechanism 25 along the length of tile 10.

With specific reference to FIG. 2, the lower surface 20 of tile 10 is shown in greater detail. The lower surface 20 contains support points comprising of a series of cup shaped projections 30. The cup shaped projections 30 are evenly dispersed throughout the lower surface 20. The cup shaped projections 30 allow tile 10 to contain depth without using excessive amount of material. In addition, the cup shaped projections 30 maintain the upper surface 15 level and prevent depressions from being created on upper surface 15 when individuals place their weight onto the tiles 10. A number of different projections can be used as support points in order to provide stability to a hockey tile of the present invention. A worker skilled in the relevant art would be familiar with a number of different projections allowing support of the present hockey tile.

With specific reference to FIG. 3, a bottom view of a hockey flooring tile 10 is shown. The bottom view further illustrates the numerous interconnecting mechanisms 25 positioned on all sides of tile 10 or along the edges of tile 10. The interconnecting mechanisms 25 are further comprised of a series of repeating necks 26 and a series of repeating furrows 27 wherein each neck has a similar shape and each furrow has a similar shape which is different than the shape of a neck. This interconnecting mechanism allows for necks and furrows to interconnect with another flooring tile of the present invention. The interconnecting mechanism 25 allow for adjacent hockey floor tiles 10 to interconnect with one another through the mating of necks 26 and furrows 27. The specific patterns of the interconnecting mechanisms 25 allows an interconnection between adjacent hockey floor tiles 10 in only one orientation.

With further reference to FIG. 3 and according to one embodiment of the present invention, a guiding neck 28 is positioned within the series of necks and furrows along the edge of a hockey flooring tile. The guiding neck 28 facilitates the interconnection of two flooring tiles given the unique shape of the guiding neck 28 versus the shape of neck 26. In one embodiment, guiding neck 28 can be positioned on each edge of a flooring tile. In another embodiment, the guiding neck can be limited to only two edges of a flooring tile.

Figure 4:
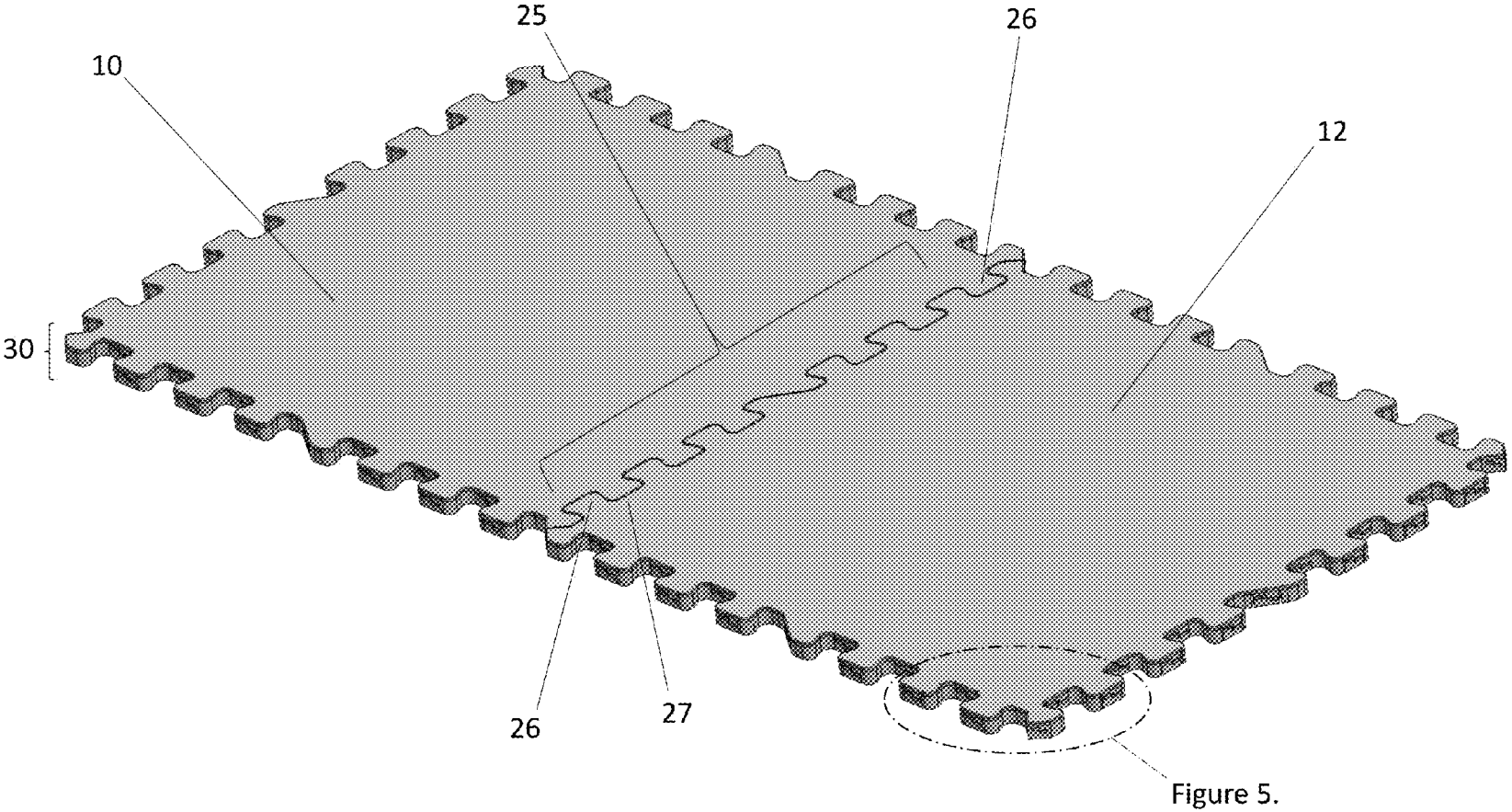
FIG. 4 is a perspective view of two hockey floor tiles interconnected according to one embodiment of the present invention.
Figure 5:
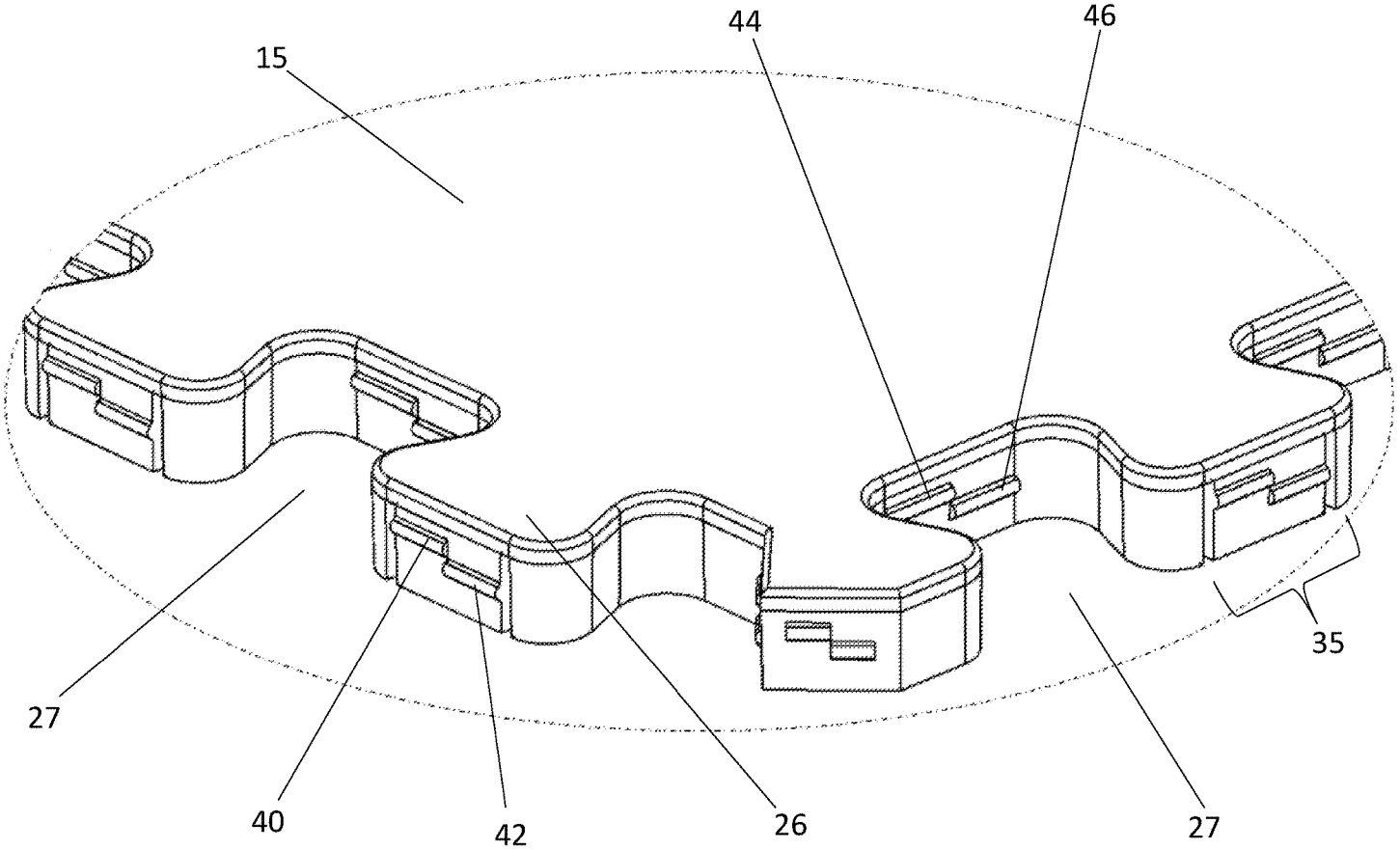
FIG. 5 is a magnified perspective view of a corner of a hockey floor tile as shown in FIG. 4 according to one embodiment of the present invention.

With reference to FIGS. 4 and 5, and according to one embodiment of the present invention, two hockey floor tiles 10 and 12 are shown interconnected. The interconnection between the two hockey floor tiles 10 and 12 is possible through a neck-furrow pattern thereby locking the adjacent hockey floor tile and preventing the formation of large gaps between the tiles 10 and 12. The hockey floor tiles 10 and 12 can be interconnected in any diagonal direction to form a surface of various length and width.

With specific reference to FIG. 5, a magnified view of a corner of the hockey floor tile 12 is shown. The corner edge of tile 12 shows a locking mechanism positioned within the interconnecting mechanism 25. To further lock adjacent tiles together, the neck 26 has a moveable surface 35 having a first and second nubs 40 and 42. Each neck 26 of a hockey tile has first and second nubs 40 and 42. Furrow 27 on hockey tile 10 also has first and second nubs 44 and 46 on every furrow positioned on a hockey tile. The first and second nubs 40 and 42 are aligned with an offset to one another with nub 40 being higher than nub 42. First and second nubs 44 and 46 are also are aligned with an offset to one another with nub 44 being higher than nub 46. A worker skilled in the relevant art would appreciate the various orientations of the first and second nubs 40, 42, 44 and 46 which would facilitate a locking of adjacent tiles. Moveable surface 35 will interconnect with a furrow having first and second nubs and the moveability of surface 35 will allow the nubs of interconnecting neck and furrow and lock the tiles to one another. The surface 35 will move inwards through a pivoting of surface 35 allowing nubs of a neck to overlap the nubs in the furrow. This interconnection will be further explained below.

Figure 6:
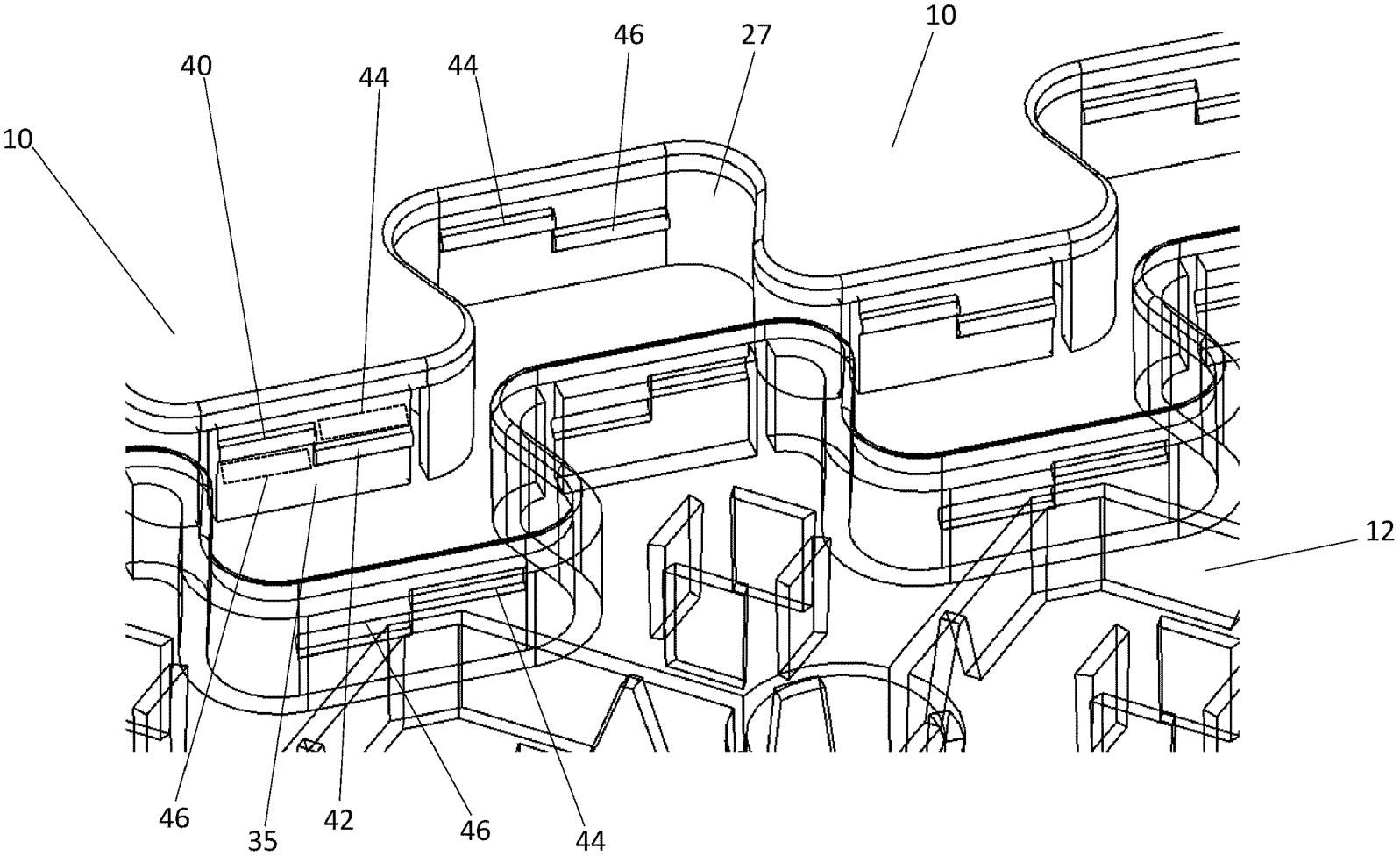
FIG. 6 is a magnified view of a first and a second hockey floor tiles aligned allowing an interconnection between the tiles according to one embodiment of the present invention.

With reference to FIG. 6, and according to one embodiment of the present invention, the interconnection of two adjacent tiles 10 and 12 is shown in greater detail. Tile 12 is shown as transparent to further illustrate the locking mechanism. The first and second nubs, 40 and 42 of tile 10 align and engage with nubs 44 and 46 on panel 12 and shown in outline as nubs 44 and 46 on panel 10. Nubs 44 and 46 are aligned with an offset to allow for nub 46 to be positioned underneath and next to nub 40 while nub 44 from tile 12 is positioned on top and next to nub 42 of tile 10 forming a pattern of 4 nubs in a rectangular shape. The moveable surface 35 allows for the nubs to interact and interconnect adjacent synthetic ice panels. The nubs on the moveable surfaces and the furrows are all aligned with an off set allowing for an alignment of 4 nubs in a rectangular shape between two adjacent panels.

Figure 6A:
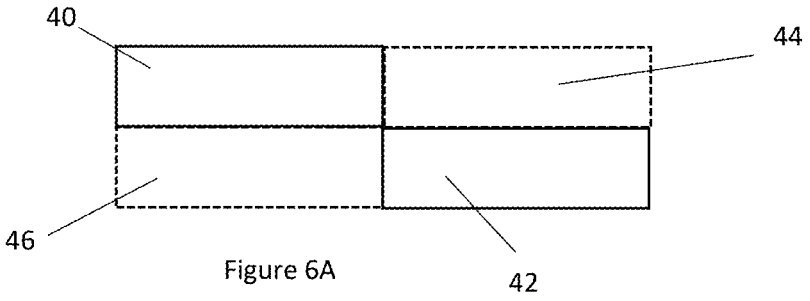
FIG. 6A is a front view of the final position of nubs from interconnected and adjacent tiles according to one embodiment of the present invention.

With reference to FIG. 6A and according to one embodiment of the present invention, the placement of the first and second nubs are shown when two tiles are interconnected to one another. The interaction between these nubs consist of the locking mechanism of the present invention. Nubs 40 and 42 are typically nubs positioned within a furrow whereas nubs 44 and 46 are nubs positioned on a neck on a moveable surface as described above as shown on tiles 10 and 12 of FIG. 6. The placement of nubs 40, 42, 44 and 46 in this position provides a locking position for two tiles. This locking position can be reproduced an infinite number of times depending on the number of tiles being interconnected to one another through necks and furrows positioned along the edge of a hockey flooring tile of the present invention.

Figure 6B:
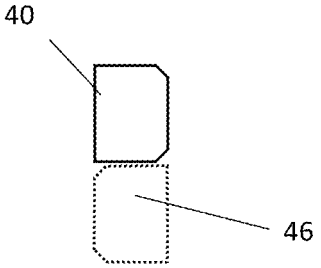
FIG. 6B is a side view of two nubs from interconnected and adjacent tiles according to one embodiment of the present invention.
Figure 6C:
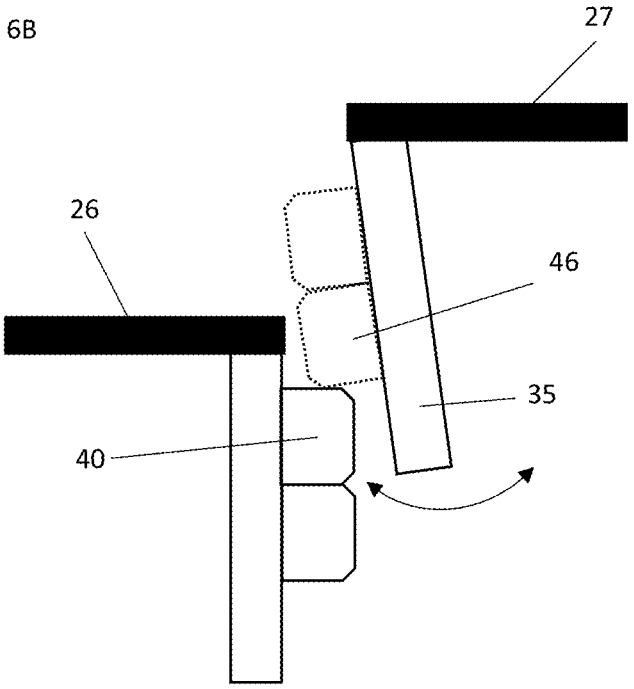
FIG. 6C is a side view of a furrow interacting with a neck from two adjacent and interconnected tiles according to one embodiment of the present invention.

With reference to FIGS. 6B and 6C and according to one embodiment of the present invention, a side view of nubs 40 and 46 are shown interacting between two adjacent tiles. As shown in FIG. 6C, in order to interconnect two adjacent tiles, moveable surface 35 on furrow 27 with nub 46 will move inward allowing nub 46 to travel over nub 40 and rest underneath nub 40 once nub 46 has cleared nub 40. The final position of nubs 40 and 46 are shown in FIG. 6B since moveable surface 35 will pivot inward after nub 46 has cleared nub 40. A worker skilled in the relevant art would be familiar with the required elasticity of moveable surface 35 in order to allow nub 46 to travel over nub 40 as shown in FIG. 6C. The interaction between nub 40 and 46 as an example effectively locks the top surfaces of adjacent tiles on a same plane which prevents tiles to move vertically in relation to one another when a series of tiles are attached together and a number of nubs lock a series of tiles. The nubs can be of various shapes as would be known by a worker skilled in the relevant art.

Figure 7:
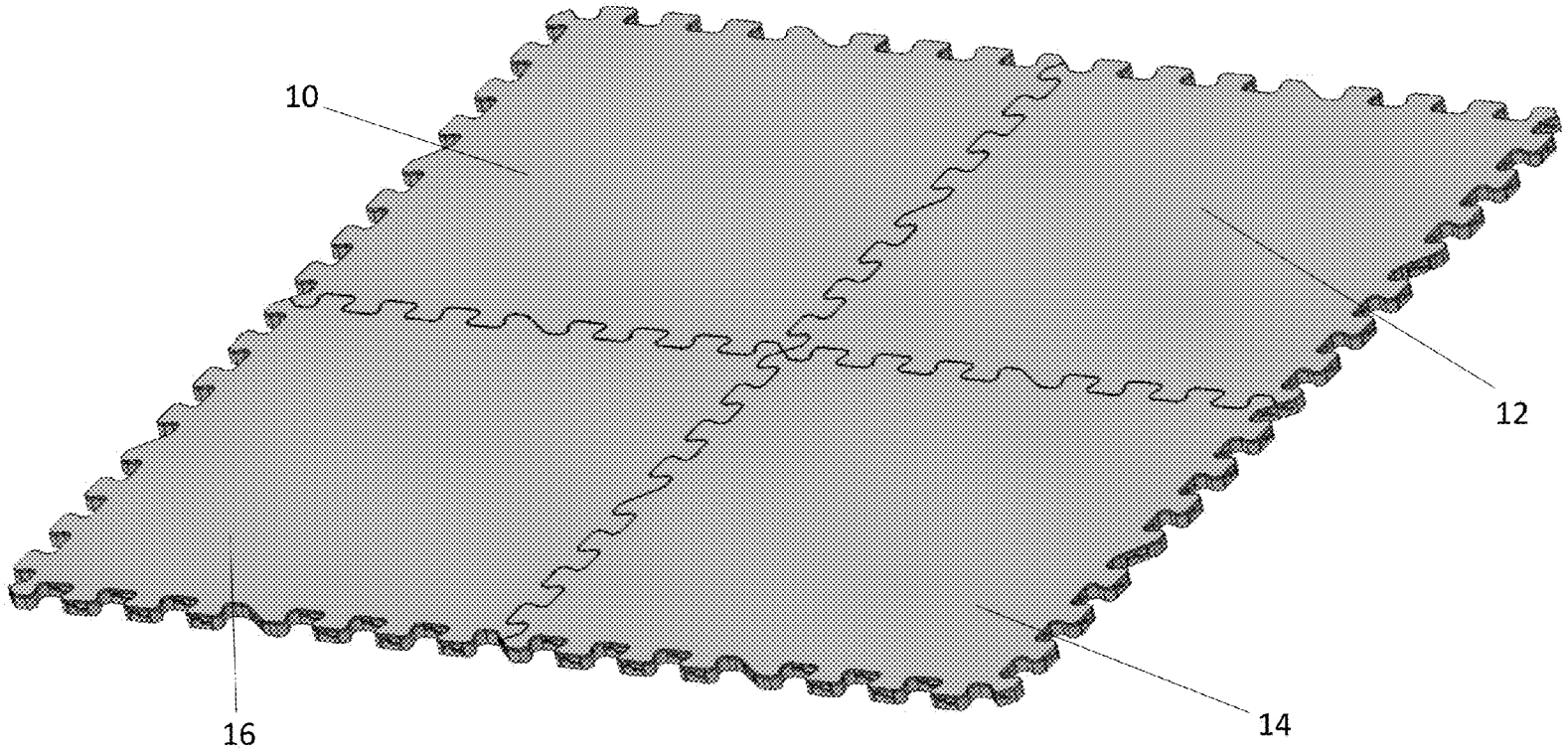
FIG. 7 is perspective view of four hockey floor tiles interconnected into each other according to one embodiment of the present invention.

With reference to FIG. 7, and according to one embodiment of the present invention, a set of four hockey floor tiles 10, 12, 14 and 16 are shown interconnect to form a surface. Each tile is interconnected into an adjacent tile based on the interconnecting mechanisms and locking mechanisms on the neck and furrows of the tiles. Depending on the user's requirement numerous hockey flooring tiles can be interconnected onto each other to form a synthetic ice surface of any dimension.

The interconnecting mechanism of the present hockey flooring tile can consist of a series of necks and furrows positioned along the edges of a flooring tile. A neck of a tile can be placed within a furrow of another tile allowing two tiles to be interconnected and provide the interconnecting mechanism of the present tile.

The locking mechanism of the present hockey flooring tile consist of providing nubs being aligned with an off set on the furrows and necks of the hockey floor tile. The locking of two adjacent hockey flooring tiles occurs when the nubs of an interconnected neck and furrow from two tiles position the nubs within a locked position.

A worker skilled in the relevant art would be familiar with various shapes that could be used in the interconnecting mechanism and is not to be limited to necks and furrows as shown in the description.

The invention claimed is:

1. A hockey flooring tile comprising:

a top smooth surface for passing pucks;

at least one interconnecting mechanism allowing for an interconnection with at least one adjacent hockey flooring tile;

at least one locking mechanism positioned within the at least one interconnecting mechanism allowing for the hockey flooring tile to be locked to the at least one adjacent hockey flooring tile, the at least one locking mechanism further comprised of moveable surfaces having at least two raised locking members to interconnect with two opposed and offset raised locking members of the at least one adjacent hockey flooring tile, the moveable surfaces pivotable about an axis to facilitate the interconnection between the hockey flooring tile and the at least one adjacent hockey flooring tile; and a bottom surface having support points to support the hockey flooring tile when a weight is placed on the hockey flooring tile, wherein the at least two raised locking members of the hockey flooring tile are arranged diagonally from one another to facilitate the interconnection with the two opposed and offset raised locking members of the at least one adjacent hockey flooring tile.

2. The hockey flooring tile of claim 1, further comprising one or more guiding necks located along one or more edges of the hockey flooring tile allowing to guide the interconnection between the hockey flooring tile and the at least one adjacent hockey flooring tile.

3. The hockey flooring tile of claim 1, wherein the support points are further comprised of cup shaped projections.

4. The hockey flooring tile of claim 1 wherein the interconnecting mechanism is comprised of a series of necks and a series of furrows along edges of the hockey flooring tile, and wherein the moveable surfaces are positioned on the series of necks.

5. The hockey flooring tile of claim 4, wherein the series of furrows are further comprised of at least two protruding locking members to further lock the hockey flooring tile to the at least one adjacent hockey flooring tile.

* * * * *